US007086702B1

(12) United States Patent
Hurt

(10) Patent No.: US 7,086,702 B1
(45) Date of Patent: Aug. 8, 2006

(54) KNEELING STOOL

(75) Inventor: Daniel P. Hurt, Spring Park, MN (US)

(73) Assignee: Legacy Holdings, Inc., Watertown, MN (US)

( * ) Notice: Subject to any disclaimer, the term of this patent is extended or adjusted under 35 U.S.C. 154(b) by 0 days.

(21) Appl. No.: 10/968,204

(22) Filed: Oct. 19, 2004

(51) Int. Cl.
*A47C 7/50* (2006.01)

(52) U.S. Cl. ..... 297/423.11; 297/423.12; 297/188.8; 297/188.19; 280/32.5

(58) Field of Classification Search ..... 297/423.12, 297/423.11; 248/188.7, 188.8
See application file for complete search history.

(56) References Cited

U.S. PATENT DOCUMENTS 4,589,699 A * 5/1986 Dungan ..... 297/423.12
5,149,174 A * 9/1992 Charash ..... 297/423.12
5,667,278 A * 9/1997 Li ..... 297/423.13
5,669,669 A * 9/1997 Usher ..... 297/423.12
5,720,517 A * 2/1998 Prothro, Sr. ..... 297/195.11
6,302,413 B1 * 10/2001 Comeaux ..... 280/32.5

FOREIGN PATENT DOCUMENTS

WO WO 88/00016 * 1/1988

* cited by examiner

*Primary Examiner*—Laurie K. Cranmer
(74) *Attorney, Agent, or Firm*—Haugen Law Firm PLLP

(57) ABSTRACT

A compactable kneeling stool apparatus includes a base portion and a seat portion which is operably coupled to the base portion via a seat post member disposed between the seat portion and the base portion. The pivot connection selectively enables the seat post member to pivot with respect to the base portion, thereby selectively adjusting a height dimension defined between the seat portion and the base portion to a desired one of a plurality of distinct pivot positions about an axis defined by the pivot connection. The selective adjustment is preferably provided by a releasable locking mechanism that is operable with the seat post member to selectively position the seat portion in a desired one of a plurality of distinct predetermined locations with respect to the base portion.

4 Claims, 8 Drawing Sheets

110
116
115
138
163
108
117
162
117
124
164

210
214
216
230
272
212

KNEELING STOOL

FIELD OF THE INVENTION

The present invention relates to portable stools generally, and more particularly to collapsible kneeling stools for use in, for example, gardening applications, and which kneeling stools incorporate seat portions having a selectively adjustable height with respect to the base of the stool. In this manner, the kneeling stools of the present invention may be custom-sized in order to most comfortably fit the associated user.

BACKGROUND OF THE INVENTION

A wide variety of devices have been used by gardeners to make the kneeling position assumed during gardening more comfortable. Such devices include, for example, knee pads, kneeling pads, and stools. Conventional stools utilized by gardeners, however, typically fail to provide a comfortable and natural position from which to perform gardening duties such as planting, weeding, and the like. Most typically, in fact, conventional garden stools provide a fixed seating position, which is not overly beneficial to the user in performing common gardening tasks.

While some stools such as gardening stools are configured to support the user in a kneeling position, conventional kneeling stools typically provide only a single configuration, with the relative height of the seat portion and the relative spacing between the seat and the front of the stool being fixed in dimension. As a result, users of different sizes are not able to utilize such stools in a working position that is most comfortable and ergonomically sound. Moreover, such fixed-configuration kneeling stools are relatively bulky and difficult to store and ship.

It is therefore a principal object of the present invention to provide a compactable kneeling stool having mechanisms for the user to selectively adjust the relative locations of the body supporting portions of the stool.

It is a further object of the present invention to provide a kneeling stool having overall dimensions appropriate for use in gardening applications, and which kneeling stool has a selectively adjustable seat height.

It is a still further object of the present invention to provide a portable and compactable kneeling stool that provides a selectively adjustable overall configuration so as to enable a user-customizable fit.

It is another object of the present invention to provide a kneeling stool having a repositionable seat portion and repositionable knee pads integrated with the stool.

SUMMARY OF THE INVENTION

By means of the present invention, a compactable and adjustable kneeling stool is provided for use in a variety of applications, such as during gardening work. The portable kneeling stool apparatus of the present invention preferably incorporates a selectively adjustable seat portion for both adjusting the relative height of the seat portion above the ground, as well as to selectively adjust spacing between the seat portion and an integrated knee pad. In this manner, the kneeling stool apparatus of the present invention is user-customizable to enable an adjustable user fit.

In a particular embodiment, the kneeling stool apparatus of the present invention includes a base portion, a seat post member, and a seat portion, with the seat post pivotally connecting the seat portion to the base portion. The kneeling stool apparatus further includes a pivot connection which selectively enables the seat post to pivot with respect to the base, with the pivot connection providing a plurality of distinct pivot positions of the seat post about an axis defined by the pivot connection. Preferably, the kneeling stool apparatus additionally includes a knee pad that is pivotally coupled to a first end of the base portion so as to be selectively positionable between a relatively compact closed orientation and an open operating orientation.

DETAILED DESCRIPTION OF THE PREFERRED EMBODIMENTS

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Figure 1:
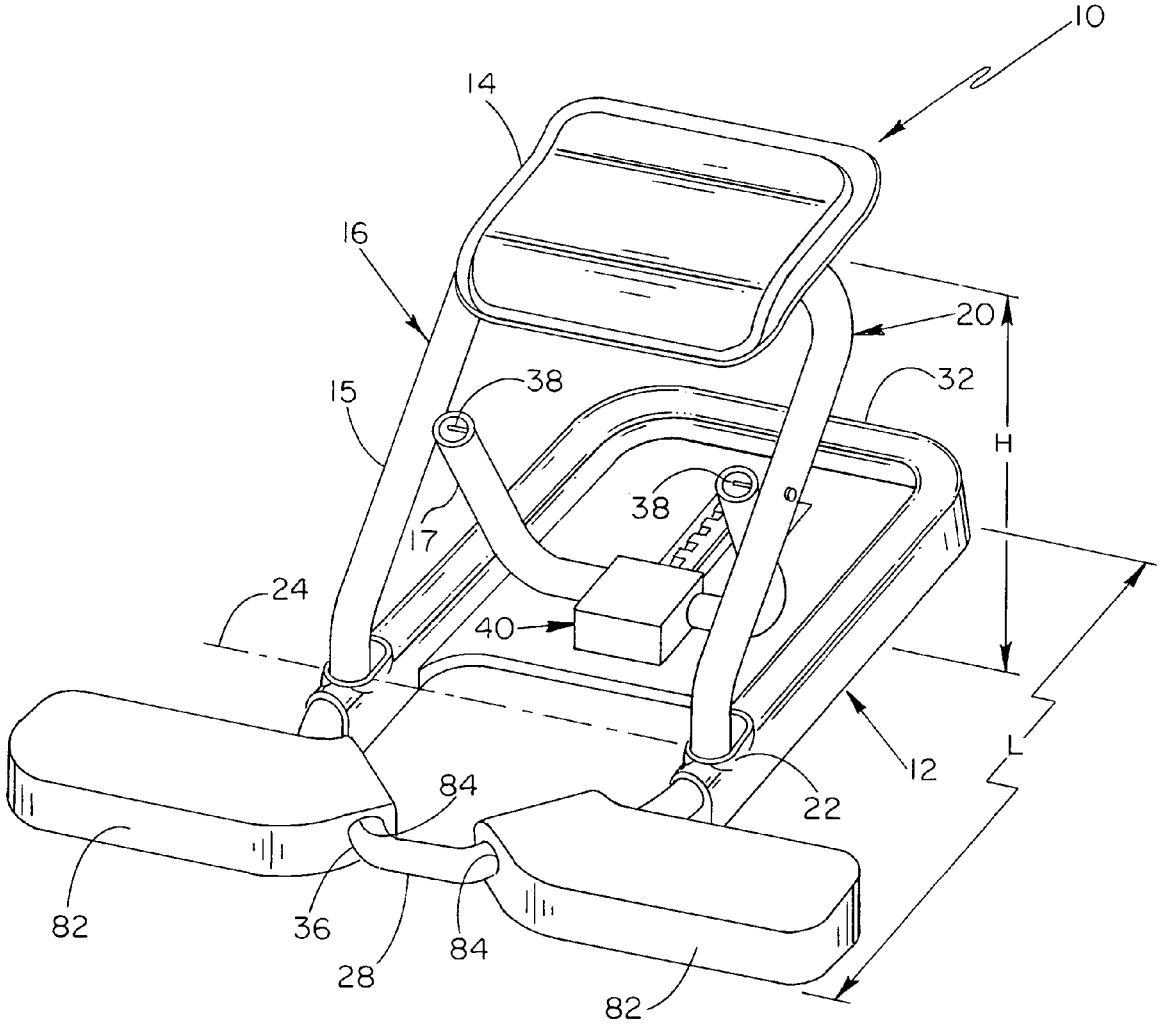
FIG. 1 is a perspective view of a kneeling stool apparatus of the present invention.
Figure 2:
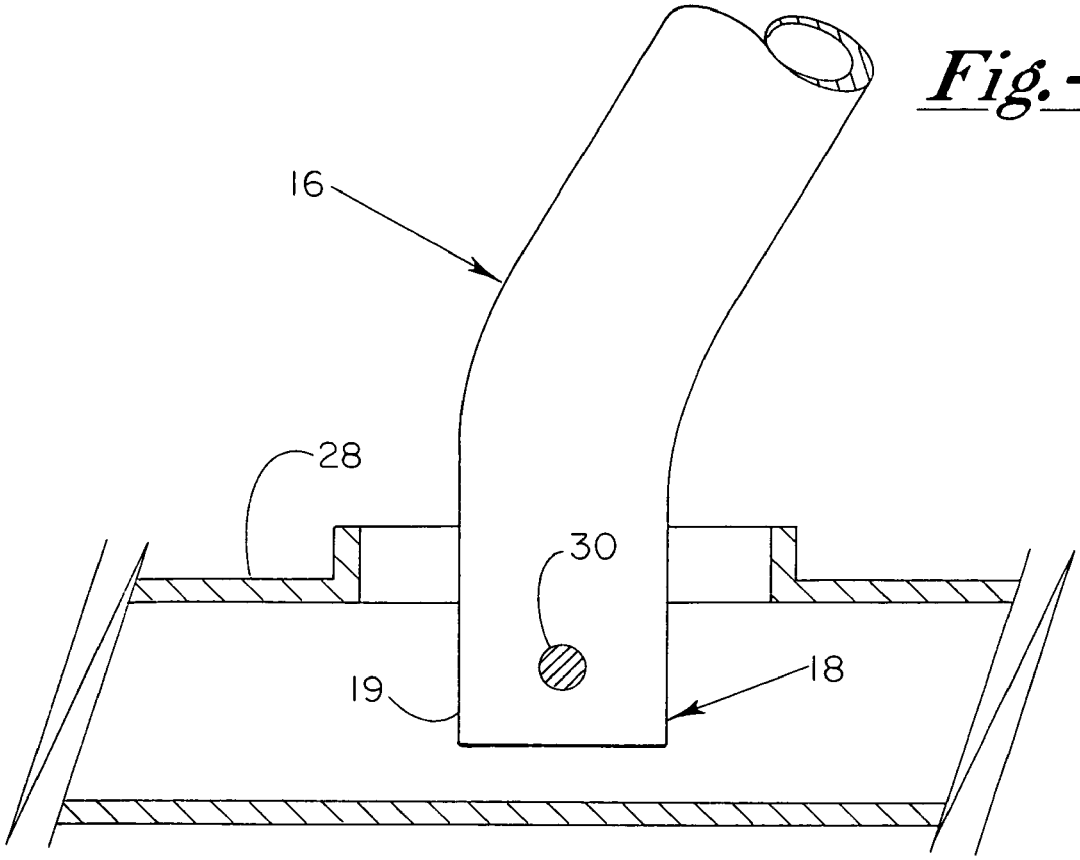
FIG. 2 is an enlarged side view of a portion of the kneeling stool apparatus illustrated in FIG. 1.
Figure 2A:
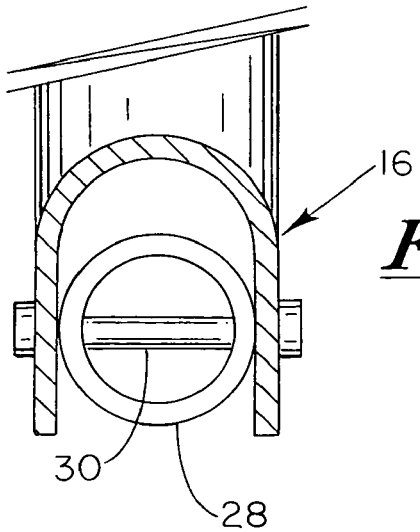
FIG. 2A is a cut-away enlarged end view of a portion of the kneeling stool apparatus illustrated in FIG. 1.

With reference now to the drawing figures, and first to FIG. 1, kneeling stool apparatus 10 includes a base 12 and a seat portion 14 that is operably coupled to base 12 via seat post member 16. In the embodiment illustrated in FIG. 1, seat post member 16 is pivotally coupled to base 12 at pivot connection 22, which pivot connection 22 enables seat post member 16 to operably and selectively pivot about first pivot axis 24 that is aligned substantially perpendicularly to length "L" of base 12. Although the present invention contemplates a variety of configurations for pivot connection 22, an example pivot connection 22 is illustrated in FIG. 2, wherein seat post member 16 is pivotally secured to anchor bar 28 via pivot pin 30 extending through respective apertures in seat post member 16 and anchor bar 28 along first pivot axis 24. In order to pivotally engage with anchor bar 28, therefore, proximal end 18 of seat post member 16 preferably includes respective flange members 19 which operably abut an outer perimeter of anchor bar 28. Such a relationship is illustrated in the end view of FIG. 2A. The present invention, however, contemplates a wide variety of pivot connections 22 which accomplish a pivot characteristic for seat post member 16 about first pivot axis 24.

Due to the fact that the operable pivoting of seat post member 16 about first pivot axis 24 acts to move distal end 20 of seat post member 16 alternatively toward or away from base 12, a relative height dimension "H", as defined between seat portion 14 and base 12, may be selectively adjusted. In preferred embodiments of the present invention, seat post member 16 may be pivotally secured into a selective one of a plurality of distinct predetermined locations about first pivot axis 24. As such, height "H" of seat portion 14 may be correspondingly set at a plurality of different dimensions so as to provide a customizable fit for the user.

In the embodiment illustrated in FIG. 1, a releasable locking mechanism 40 is operably secured to seat post member 16, and particularly secondary leg element 17 thereof, with secondary leg element 17 being pivotally attached to the remainder of seat post member 16 via, for example, a pin 38 extending through respective apertures of secondary leg element 17 and seat connection element 15 of seat post member 16. As shown in the cross-sectional view of FIG. 3, releasable locking mechanism 40 includes a protrusion 42 that is matingly engageable with selected ones of a plurality of mating features 46 disposed in upper surface 9 of base 12. The plurality of mating features 46 may preferably be linearly disposed along length "L" of base 12, such that selective engagement of releasable locking mechanism 40 with designated ones of mating features 46 acts to releasably lock seat post member 16 in a predetermined position about first pivot axis 24.

With reference back to FIG. 1, therefore, where releasable locking mechanism 40 is selectively secured in mating features 46 progressively toward second end 32 of base 12, height dimension "H" of seat portion 14 will correspondingly decrease. By contrast, removable engagement with mating features 46 disposed more toward first end 36 of base 12 will correspondingly increase height dimension "H".

Releasable locking mechanism 40 acts to selectively affix seat post member 16 in place about first pivot axis 24 due to the gravitational forces bearing down upon secondary leg element 17, and correspondingly protrusion 42 into respective mating features 46. In order to release the lock obtained between protrusion 42 and the respective mating features 46, therefore, the user may lift seat portion 14 to thereby disengage releasable locking mechanism 40 from the respective mating features 46. Releasable locking mechanism 40 may then be repositioned in alignment with different mating features 46 to thereby alter height dimension "H" of seat portion 14.

Figure 3:
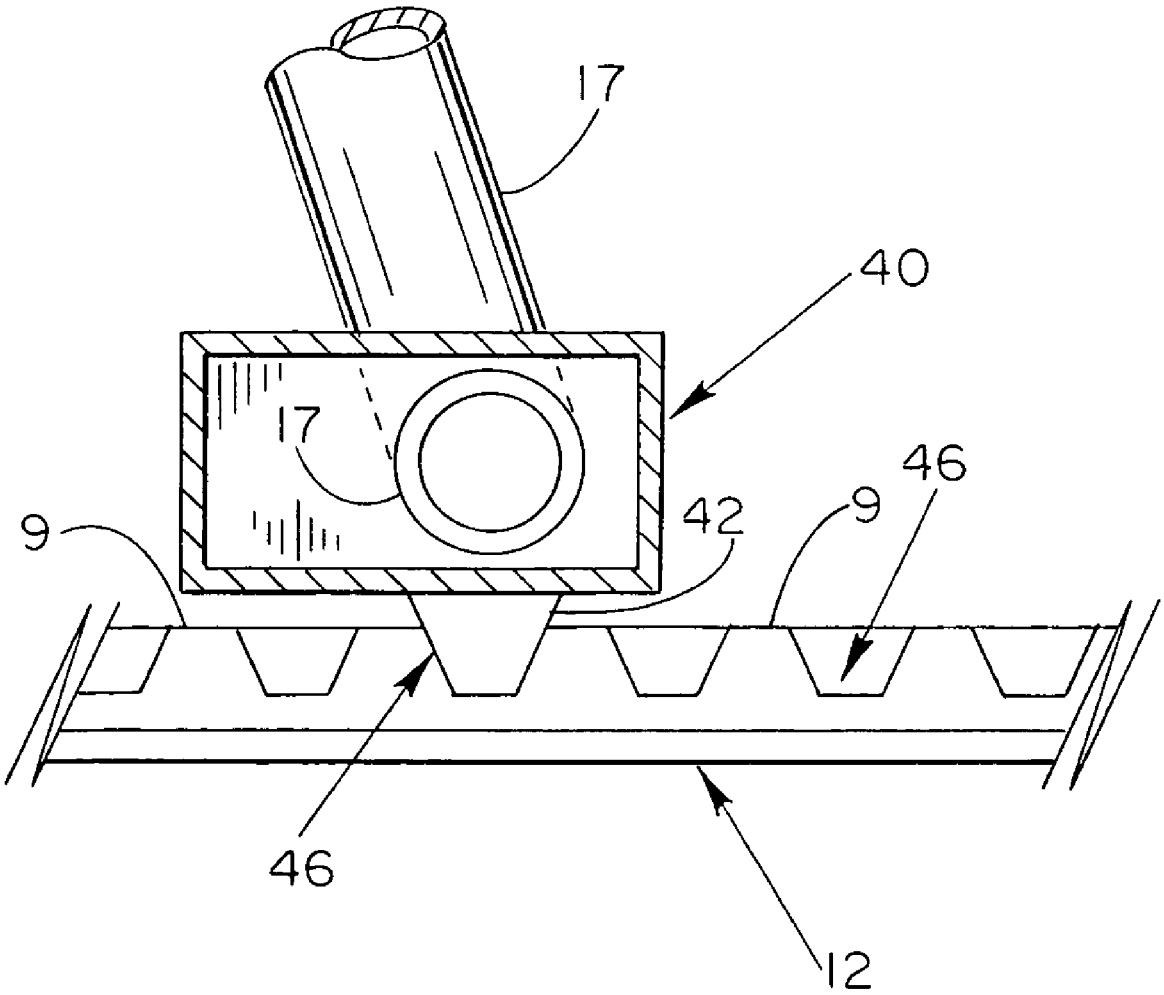
FIG. 3 is a cross-sectional side view of a portion of the kneeling stool apparatus illustrated in FIG. 1.
Figure 5:
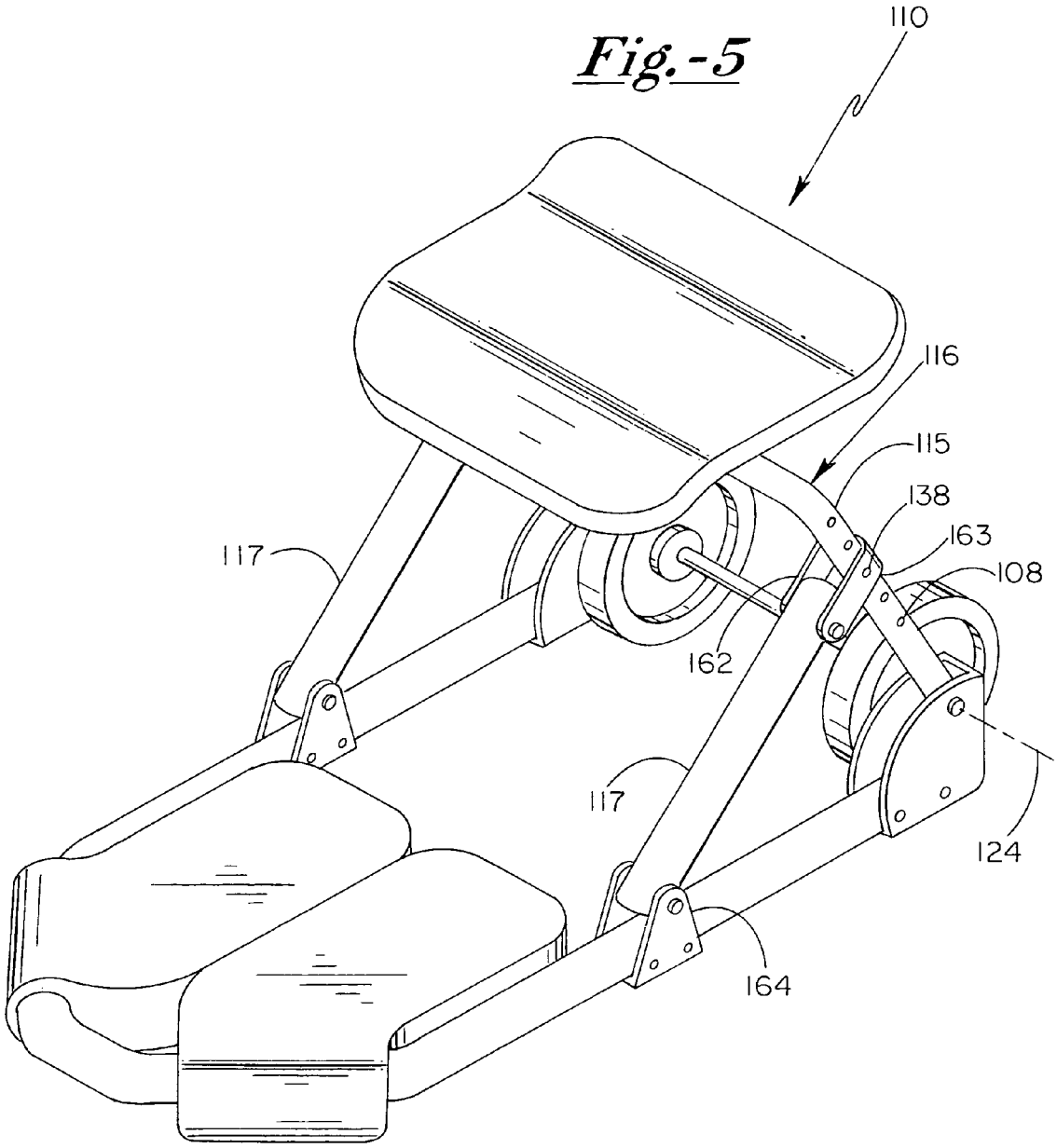
FIG. 5 is a perspective view of a kneeling stool apparatus of the present invention.
Figure 6:
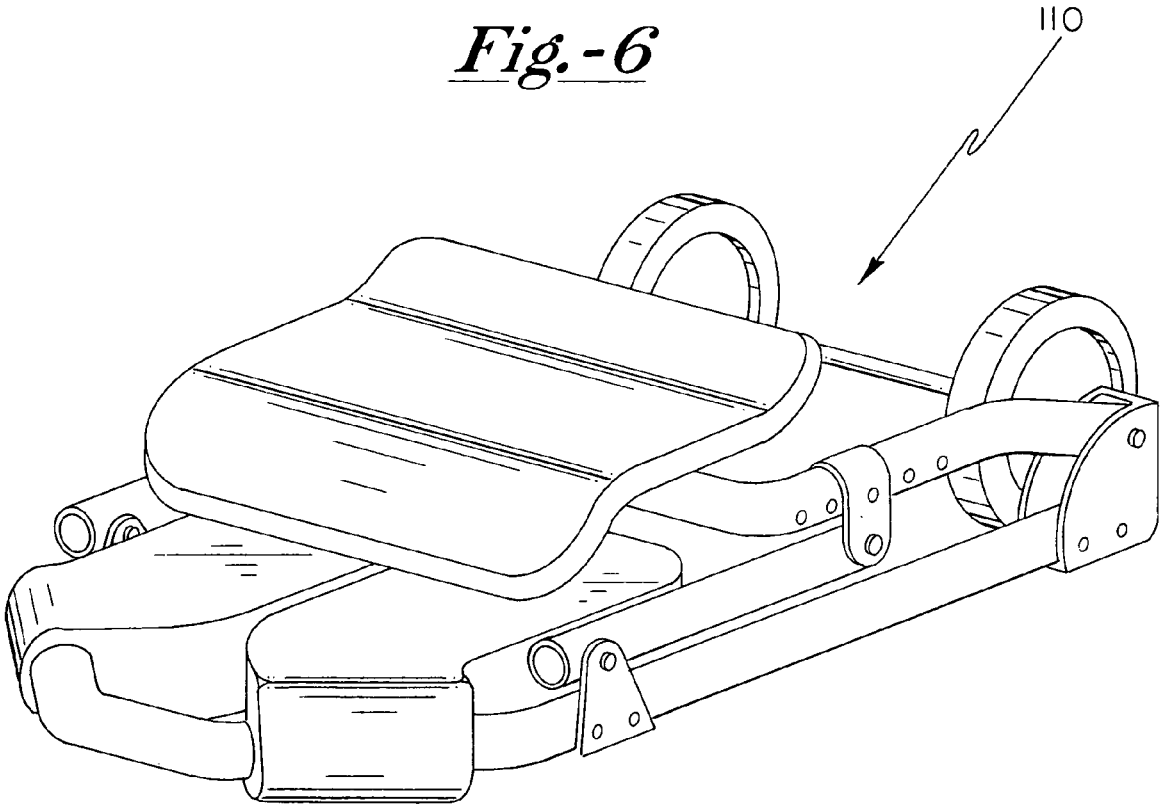
FIG. 6 is a perspective view of the kneeling stool apparatus illustrated in FIG. 5.

While releasable locking mechanism 40 is described above with reference to the embodiments illustrated in FIGS. 1 and 3, a wide variety of alternative configurations for releasable locking mechanism 40 are contemplated by the present invention. One example alternative configuration for releasable locking mechanism 40 is illustrated in FIG. 5, wherein secondary leg element 117 preferably pivots both at upper and lower junction points 162, 164, with upper junction point 162 substantially comprising a U-bracket 163 surrounding seat portion element 115 of seat post member 116. Apertures in U-bracket 163 operably align with corresponding apertures 108 in element 115 to thereby receive a respective looking pin 138 therethrough so as to selectively adjust the pivot position of seat post member 116 about first pivot axis 124. A completely folded representation of the embodiment illustrated in FIG. 5 is shown in FIG. 6.

Figure 7:
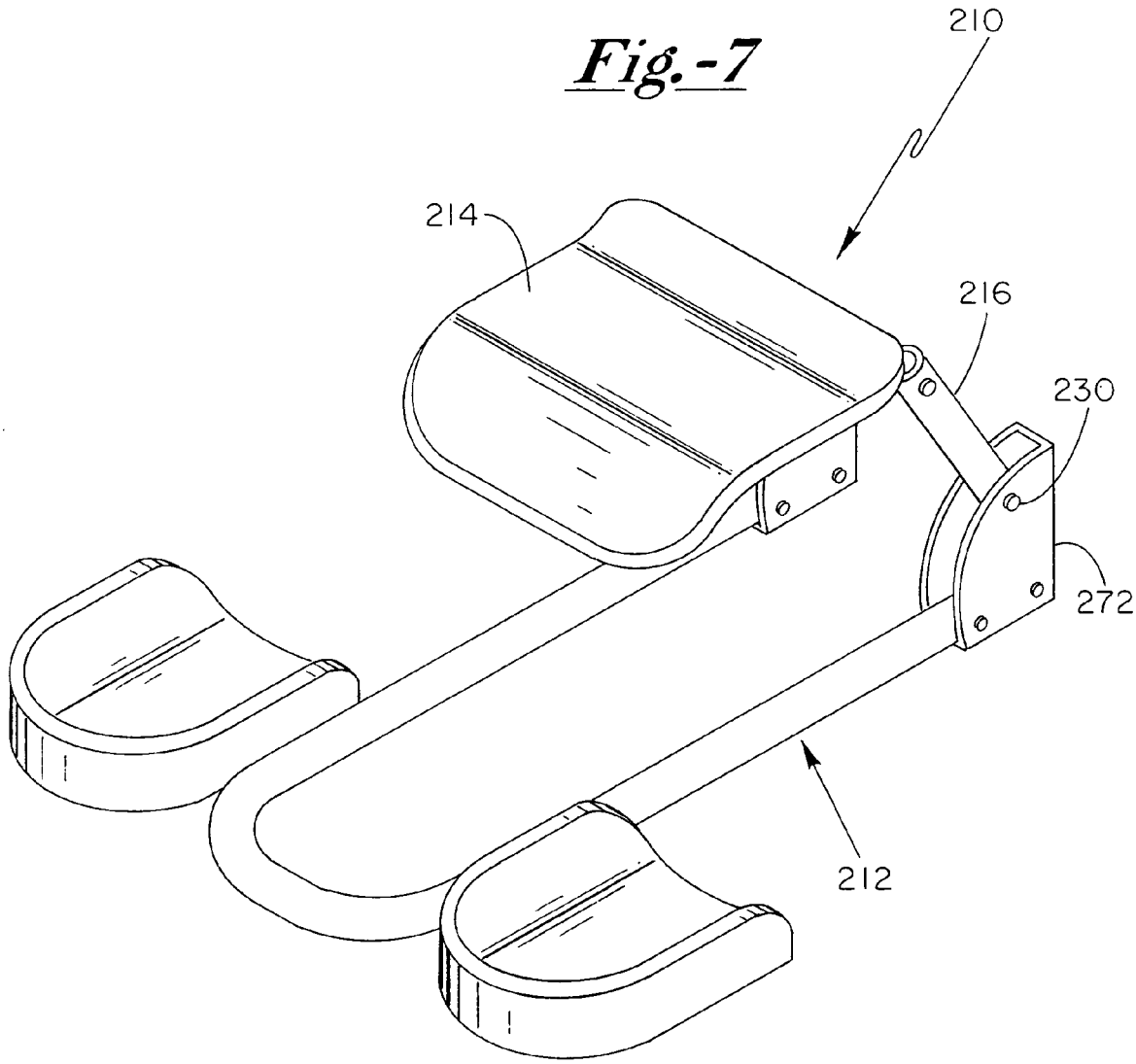
FIG. 7 is a perspective view of a kneeling stool apparatus of the present invention.

FIG. 7 illustrates kneeling stool apparatus 210 which accomplishes the selective pivoting arrangement of the above-described embodiments by seat post member 216 having an aperture disposed therein that may be operably and selectively aligned with corresponding apertures in corner bracket 272. A locking pin 230 may be inserted through such corresponding apertures for selectively securing seat portion 214 in a desired relative orientation to base 212.

Figure 8:
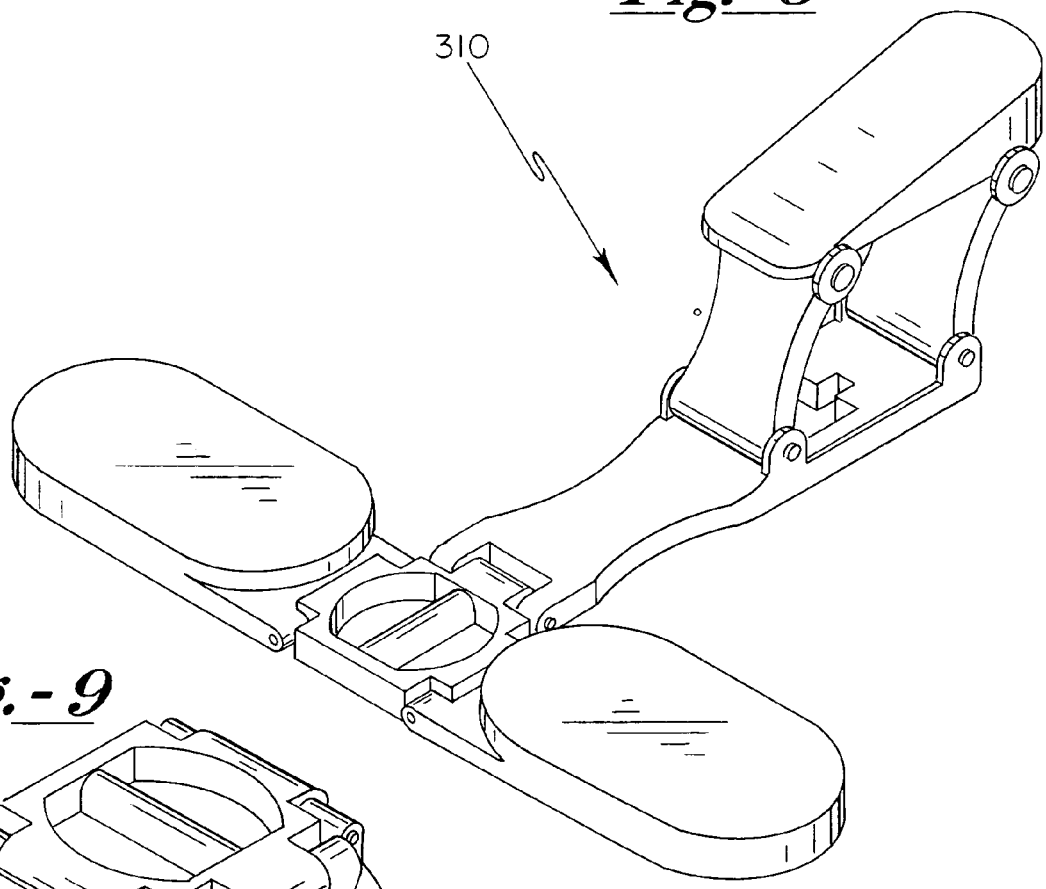
FIG. 8 is a perspective view of the kneeling stool apparatus of the present invention.
Figure 9:
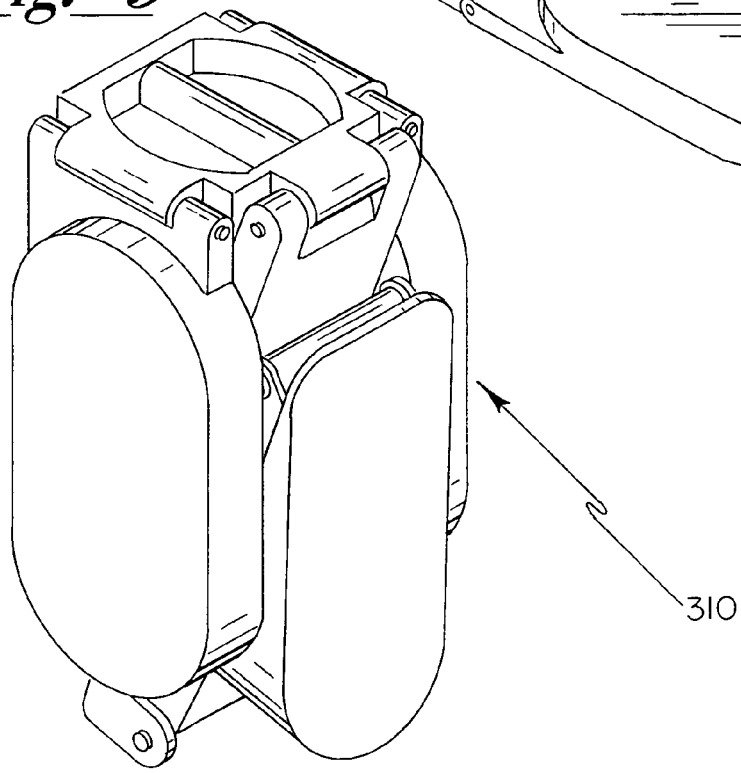
FIG. 9 is a perspective view of the kneeling stool apparatus illustrated in FIG. 8.

A further embodiment contemplated by the present invention is illustrated in FIGS. 8 and 9, with kneeling stool apparatus 310 having the seat repositioning and compactability characteristics of the embodiments illustrated and described in FIGS. 1–7.

Figure 4:
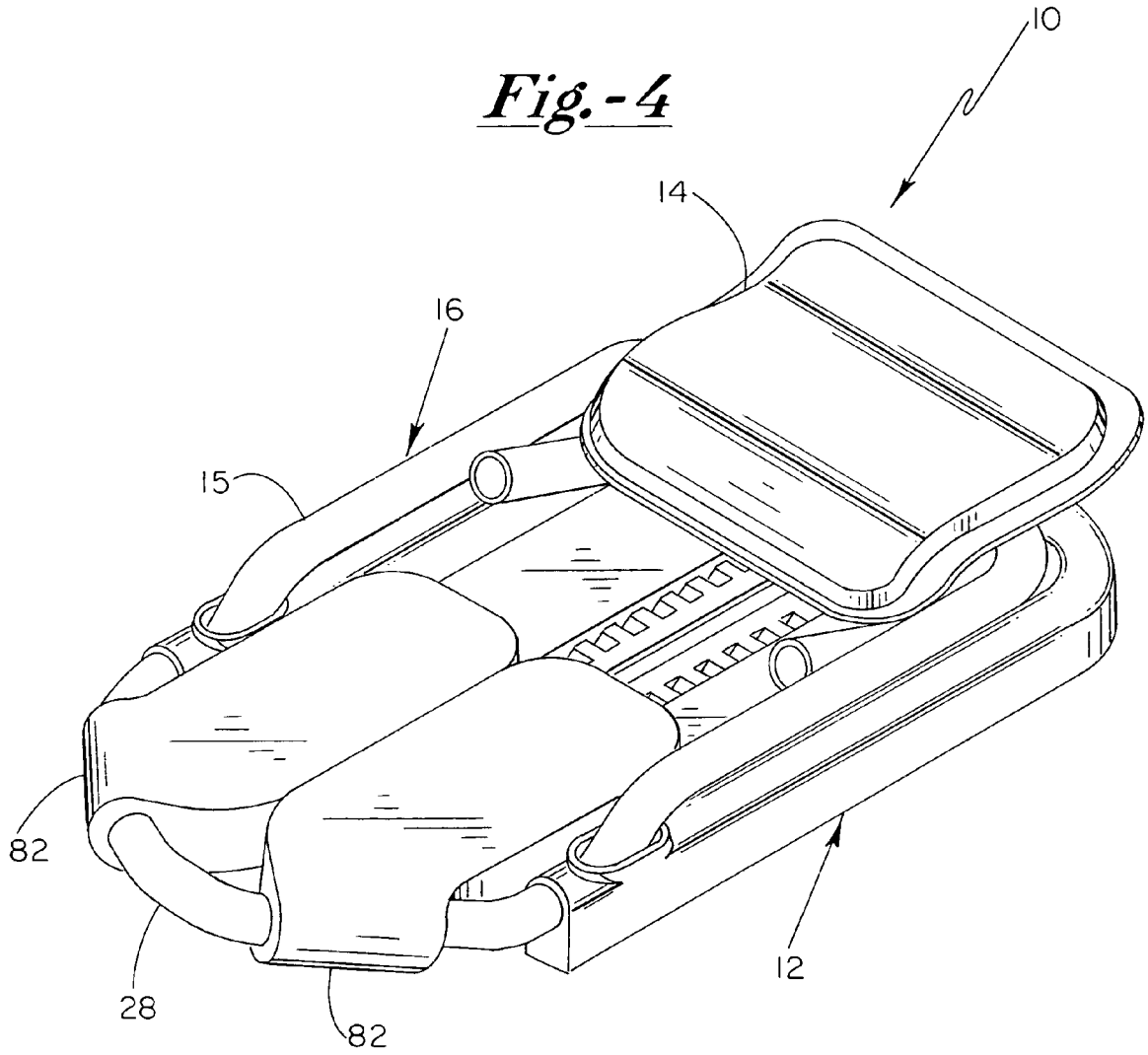
FIG. 4 is a perspective view of the kneeling stool apparatus illustrated in FIG. 1.

With reference back to the embodiment illustrated in FIG. 1, kneel stool apparatus 10 preferably includes knee pads 82 which are pivotally coupled to anchor bar 28 of base 12. Knee pads 82 preferably includes respective apertures 84 disposed therein for operably receiving anchor bar 28 therethrough. As such, knee pads 82 respectively pivot about anchor bar 28 extending through respective apertures 84. Knee pads 82 are illustrated in FIG. 1 in an open operating orientation, while knee pads 82 are illustrated in FIG. 4 in a relatively compact closed orientation. FIG. 4 further illustrates a compactability characteristic of kneeling stool apparatus 10 of the present invention, in that the entire apparatus may selectively be folded into a relatively compact configuration for ease of storage and shipment.

A variety of materials may be utilized in the construction of the kneeling stools of the present invention, with knee pads 82 and seat portion 14 including a relatively resilient material such as high-density foam for added comfort to the user in supporting the pressure points of the user's body. Seat post member 16 is preferably fabricated from a relatively strong material such as aluminum, steel, and the like for effectively and reliably supporting the user's weight upon seat portion 14. Base 12 is preferably fabricated from the relatively durable polymeric material such as polypropylene, polyethylene, and the like. However, each of the components of the kneeling stools of the present invention may be fabricated from materials useful and cost effective for the intended purpose.

In addition to the seat portion height adjustment capability of the present invention as described above, the positional adjustment of seat portion 14 through the pivoting mechanism of the present invention enables the user to adjust the relative spacing between seat portion 14 and knee pads 82 in order to provide a more preferred overall fit for the user. For example, a relatively tall user of kneeling stool apparatus 10 may selectively move releasable locking mechanism 40 toward second end 32 of base 12 to not only lower the seat height above the ground on which base 12 operably rests, but to also expand the distance between seat portion 14 and knee pad 82 to account for the relatively longer legs of the user. In such a manner, the relatively tall user is able to comfortably utilize both seat portion 14 and knee pads 82. Correspondingly, a relatively short user may selectively move releasable locking mechanism 40 toward first end 36 of base 12 to raise the height dimension "H" of seat portion 14, as well as to shorten the distance between seat portion 14 and knee pads 82 to best accommodate the relatively shorter legs of the user. Such a characteristics is specifically provided through the pivotal motion of seat post member 16 about first pivot axis 24.

The invention has been described herein in considerable detail in order to comply with the patent statutes, and to provide those skilled in the art with the information needed to apply the novel principles and to construct and use embodiments of the invention as required. However, it is to be understood that the invention can be carried out by specifically different devices and that various modifications can be accomplished without departing from the scope of the invention itself.

What is claimed is:

1. A compact kneeling stool apparatus comprising:

a base having a length and a width;

a seat portion operably coupled to said base via a seat post member disposed between said seat portion and said base;

a pivot connection selectively enabling said seat post member to pivot with respect to said base, thereby selectively adjusting a height dimension defined between said seat portion and a bottom surface of said base wherein said seat post member has a length at least about as great as said height dimension; and a knee pad pivotally coupled to a first end of said base so as to be selectively positionable between a relatively compact closed orientation and an open orientation the apparatus being selectively configurable into a compact configuration wherein said seat post member axially extends substantially parallel to a plane defined by the length and width of said base.

2. A compact kneeling stool apparatus as in claim 1 wherein said pivot connection defines a first pivot axis that is aligned substantially perpendicularly to the length of said base.

3. A compact kneeling stool apparatus as in claim 2 wherein said seat post member operably pivots about said first pivot axis generally away from said first end of said base.

4. A compact kneeling stool apparatus as in claim 1 wherein said seat post member is selectively pivotally positionable and releasably lockable in a plurality of distinct pre-determined locations about said first pivot axis.

* * * * *